US010123945B2

(12) United States Patent
Wilson

(10) Patent No.: US 10,123,945 B2
(45) Date of Patent: Nov. 13, 2018

(54) FEEDING BOTTLE APPARATUS

(71) Applicant: Sandra D. Wilson, Tulsa, OK (US)

(72) Inventor: Sandra D. Wilson, Tulsa, OK (US)

( * ) Notice: Subject to any disclaimer, the term of this patent is extended or adjusted under 35 U.S.C. 154(b) by 250 days.

(21) Appl. No.: 15/259,320

(22) Filed: Sep. 8, 2016

(65) Prior Publication Data

US 2017/0071828 A1 Mar. 16, 2017

Related U.S. Application Data

(60) Provisional application No. 62/216,433, filed on Sep. 10, 2015.

(51) Int. Cl.
*A47G 21/18* (2006.01)
*A61J 9/00* (2006.01)
*A47G 19/22* (2006.01)

(52) U.S. Cl.
CPC ..... *A61J 9/006* (2013.01); *A47G 19/22* (2013.01); *A61J 2200/76* (2013.01)

(58) Field of Classification Search
CPC .... A47G 21/18; A47G 21/182; A47G 21/186; A47G 21/189; A47G 19/2266; A47G 19/2272
USPC ..... 220/709
See application file for complete search history.

(56) References Cited

U.S. PATENT DOCUMENTS 2,783,919 A * 3/1957 Ansell ..... B65D 47/06 222/211
D378,975 S 4/1997 Reid
5,890,363 A * 4/1999 Kobayashi ..... B60T 13/146 60/552
7,172,085 B2 * 2/2007 Beaudette ..... A61J 9/00 215/11.1

FOREIGN PATENT DOCUMENTS

DE 19632013 12/1998

OTHER PUBLICATIONS

"Jump-Start Squeeze Bottle," Retrieved from the Internet: http://arearrangedlife.com/adapting/jump-start-squeeze-bottle/.
"NutriSqueeze Liquid Bottle," Retrieved from the Internet: http://www.craniorehab.com/NutriSqueeze-Liquid-Bottle--8oz-Squeeze-bottle-with-straw-for-fluids-_p_64.html.
(Continued)

*Primary Examiner* — King M Chu
(74) *Attorney, Agent, or Firm* — Dunlap Codding, P.C.

(57) ABSTRACT

A feeding bottle apparatus comprising a cylindrical bottle for containing a flowable material, having a top with an opening, a bottom, a length, at least a first portion of the bottle curving along the length, and markings indicative of an amount of flowable material; a cap attachable to the top of the bottle, having an opening aligned with the opening of the bottle; and a tube extending through the opening of the cap and the opening of the bottle, having a first end extending out of the bottle and a second end disposed within the bottle, the first end having an opening and a deflector member, the second end extending substantially the length of the bottle and having at least one bottom member; wherein the bottle is formed of a flexible material such that pressure applied to the bottle discharges the flowable material through the tube.

20 Claims, 6 Drawing Sheets

(56) References Cited

OTHER PUBLICATIONS

"Tattoo Wash Clear White Plastic Squeeze Bottle," Retrieved from the Internet: http://www.amazon.co.uk/Capacity-Tattoo-Plastic-Squeeze-Bottle/dp/B008ASY4NS.
"DTAS Large Soft-Squeeze Bottle," Retrieved from the Internet: http://www.dinnerthroughastraw.net/products.htm#bottlelg.
"ARK's Cip-Kup Assembly," Retrieved from the Internet: http://www.arktherapeutic.com/Cip-kupSAR.html.
"Maddack ABLEWARE Feeding Bottle with Flexible Tube," Retrieved from the Internet: http://www.maddak.com/feeding-bottle-with-flexible-tube-p-27994.html.

* cited by examiner

FEEDING BOTTLE APPARATUS

CROSS-REFERENCE TO RELATED APPLICATION

This application claims priority to U.S. Provisional Application Ser. No. 62/216,433, filed on Sep. 10, 2015, titled "Feeding Bottle Apparatus," the entire contents of which being hereby expressly incorporated herein by reference.

BACKGROUND

Persons with temporary or long term physical limitations that affect the ability to control movement, such as movement of the jaw, lips, tongue and throat, may have difficulty eating and drinking. Often these limitations affect the person's ability to close the lips, to chew, to move ingestible materials in the mouth and throat and/or to apply suction to feeding implements, and may require a liquid diet. Such limitations may also increase the likelihood of choking or aspiration if ingestible fluids are provided too quickly or directed straight to the back of the throat. To avoid these problems, it is preferable that the ingestible fluids be directed through the mouth to the side of the back of the throat. However, it is difficult to control the output volume and direction of flow of current feeding devices, such as syringes or squirt bottles. Other traditional feeding devices, such as bottles with straws, require the ability to apply suction and to close one's lips about the device, which may be difficult or contraindicated for those with temporary or long term physical limitations.

To this end, a need exists for an improved apparatus for providing fluids orally to persons having physical limitations in a controlled and directed manner. It is to such apparatus that the inventive concepts disclosed herein are directed.

BRIEF DESCRIPTION OF THE DRAWINGS

The accompanying drawings, which are incorporated in and constitute a part of this specification, illustrate one or more implementations described herein and, together with the description, explain these implementations.

DETAILED DESCRIPTION OF EXEMPLARY EMBODIMENTS

Figure 1:
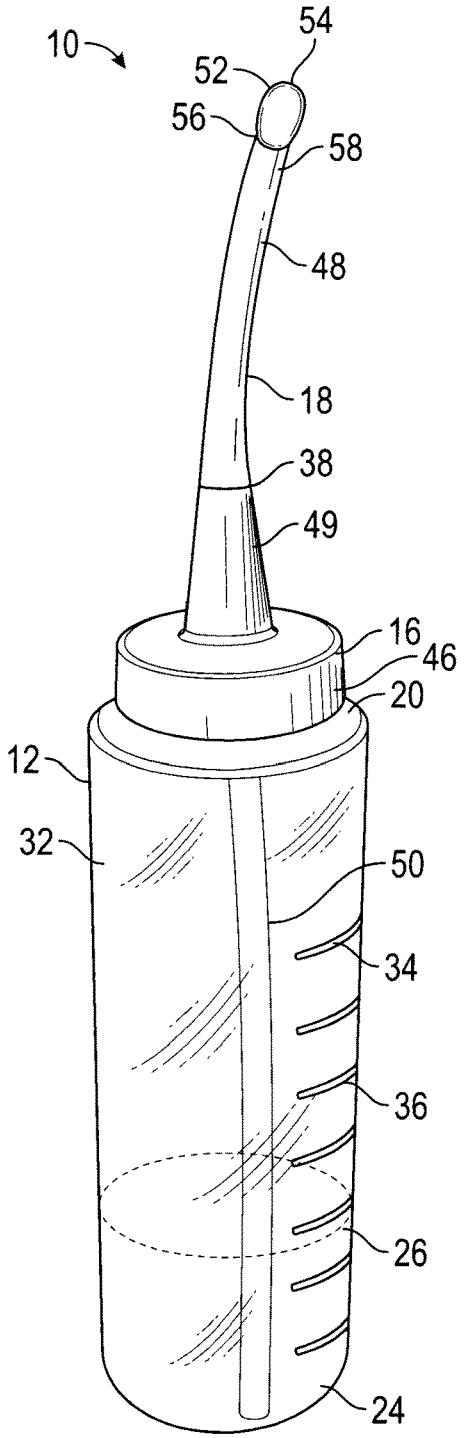
FIG. 1 is a side elevational perspective view of an exemplary feeding bottle apparatus constructed in accordance with the inventive concepts disclosed herein.

Before explaining at least one embodiment of the inventive concepts disclosed herein in detail, it is to be understood that the inventive concepts are not limited in their application to the details of construction and the arrangement of the components or steps or methodologies set forth in the following description or illustrated in the drawings. The inventive concepts disclosed herein are capable of other embodiments, or of being practiced or carried out in various ways. Also, it is to be understood that the phraseology and terminology employed herein is for the purpose of description and should not be regarded as limiting the inventive concepts disclosed and claimed herein in any way.

In the following detailed description of embodiments of the inventive concepts, numerous specific details are set forth in order to provide a more thorough understanding of the inventive concepts. However, it will be apparent to one of ordinary skill in the art that the inventive concepts within the instant disclosure may be practiced without these specific details. In other instances, well-known features have not been described in detail to avoid unnecessarily complicating the instant disclosure.

As used herein, the terms "comprises," "comprising," "includes," "including," "has," "having," and any variations thereof, are intended to cover a non-exclusive inclusion. For example, a process, method, article, or apparatus that comprises a list of elements is not necessarily limited to only those elements, and may include other elements not expressly listed or inherently present therein.

Unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B is true (or present).

In addition, use of the "a" or "an" are employed to describe elements and components of the embodiments disclosed herein. This is done merely for convenience and to give a general sense of the inventive concepts. This description should be read to include one or at least one and the singular also includes the plural unless it is obvious that it is meant otherwise.

As used herein, qualifiers like "substantially," "about," "approximately," and combinations and variations thereof, are intended to include not only the exact amount or value that they qualify, but also some slight deviations therefrom, which may be due to manufacturing tolerances, measurement error, wear and tear, stresses exerted on various parts, and combinations thereof, for example.

Finally, as used herein any reference to "one embodiment," "an embodiment," "one aspect," or "an aspect," means that a particular element, feature, structure, or characteristic described in connection with the embodiment is included in at least one embodiment. The appearances of the phrase "in one embodiment" or "in one aspect" in various places in the specification are not necessarily all referring to the same embodiment.

Figure 2:
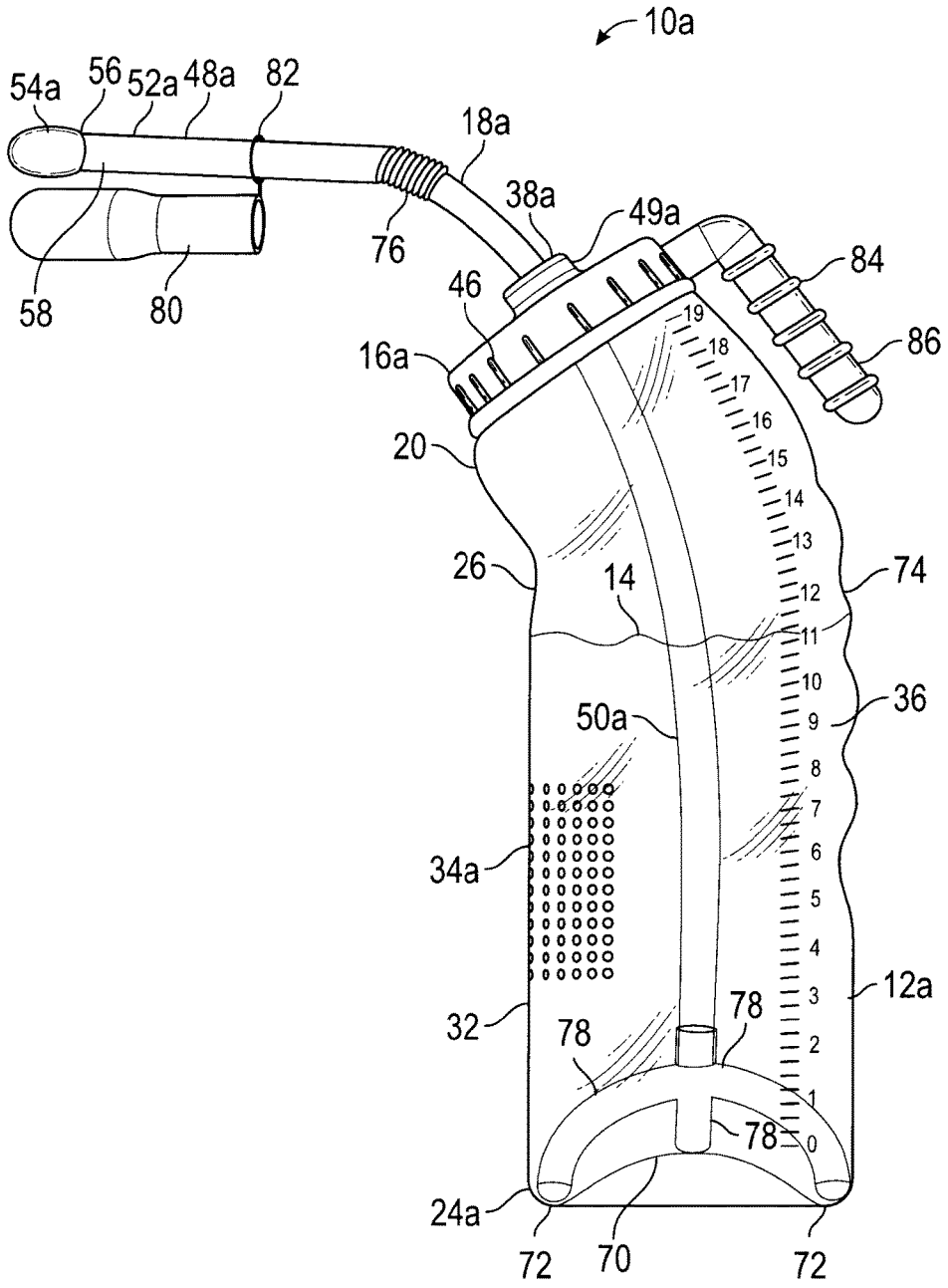
FIG. 2 is a side elevational perspective view of an exemplary feeding bottle apparatus constructed in accordance with the inventive concepts disclosed herein.

Referring now to the drawings, and more particularly to FIG. 1, a feeding bottle apparatus 10 constructed in accordance with the inventive concepts disclosed herein is illustrated. The feeding bottle apparatus 10 comprises a bottle 12 for containing a flowable material 14 (FIG. 2), a cap 16, and a tube 18. Some non-exclusive examples of flowable materials 14 include water, beverages, and liquid or semi-liquid foods.

Figure 3:
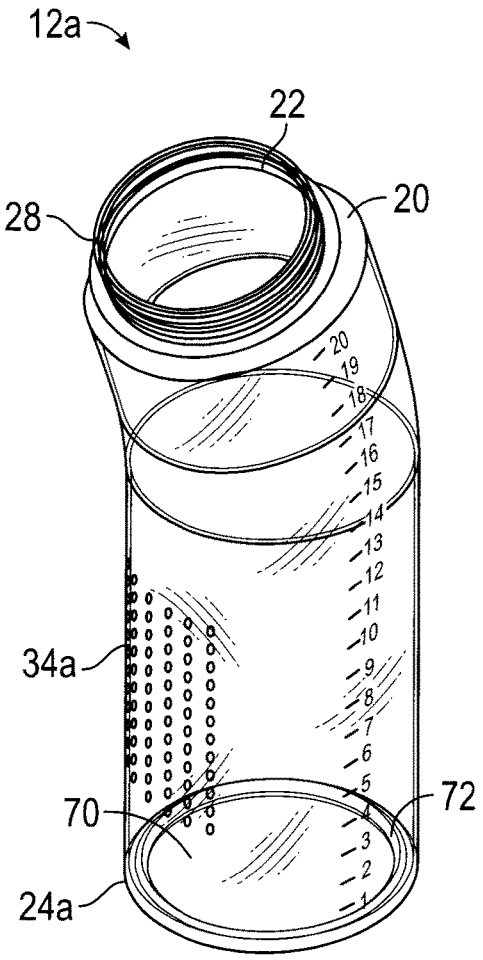
FIG. 3 is a perspective view of the bottle of the apparatus of FIG. 2.
Figure 4:
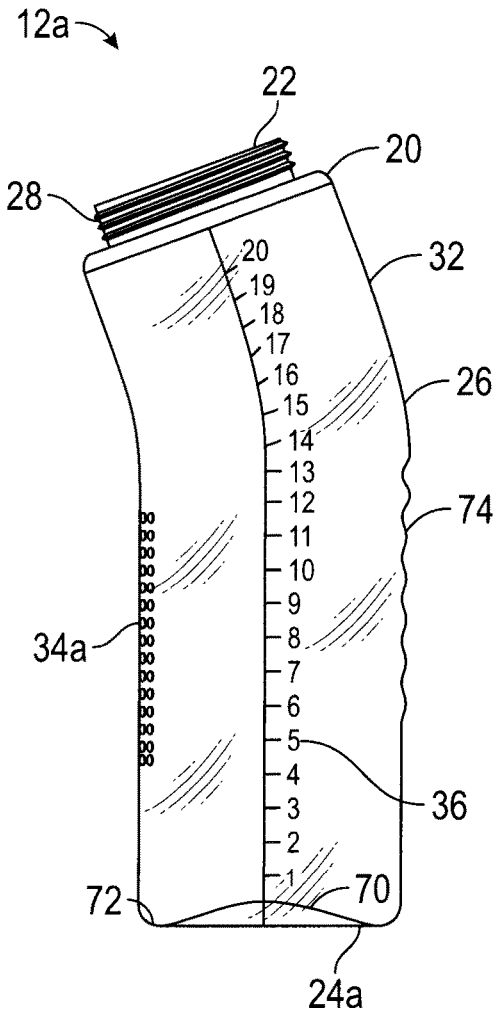
FIG. 4 is a side plan view of the bottle of the apparatus of FIG. 2.

The bottle 12 has a top 20 with an opening 22 (as shown in FIGS. 3 and 4), a bottom 24, and a length 26 between the top 20 and the bottom 24. The top 20 of the bottle 12 may have external threads 28 around the opening 22. Alternatively, the top 20 may have an external ridge (not shown) around the opening 22. In one embodiment, the bottom 24 of the bottle 12 may be substantially flat. In one embodiment, the bottom 24 of the bottle 12 may be convex. The bottle 12 may be cylindrical along its length 26.

The exterior surface 32 of the bottle 12 may have at least one textured area 34 to aid a user in maintaining contact with the bottle 12. The exterior surface 32 may have markings 36 indicative of an amount of flowable material 14 in the bottle 12. Nonexclusive examples of markings 36 are tick marks, English measurement units, metric measurement units, and/or recommended serving sizes. In one embodiment, the markings 36 are milliliters, liters, and/or cups. The markings 36 may be combinations of different measurement units and/or fractions of measurement units. In one embodiment, the markings 36 are evenly graduated amounts. The markings 36 may be raised from the exterior surface 32.

The bottle 12 may be constructed of any suitably flexible material. At least a portion of the bottle 12 is constructed of transparent or translucent material, such that a level of flowable material 14 in the bottle 12 may be ascertained through the material of the bottle 12. In one embodiment, the material may be formed of a bioplastic and/or a plastic. In one embodiment, the material may be a polyethylene, such as food grade polyethylene. In one embodiment, the material has deformation properties such that the bottle 12 requires very little pressure, such as pressure brought to bear on the bottle 12 by the fingers and/or hand of a user, to discharge the flowable material 14 contained in the bottle 12 and such that the bottle 12 returns to its original shape upon release of pressure. For instance, the material may be a food grade low density polyethylene.

The cap 16 of the feeding apparatus is attachable to the top 20 of the bottle 12 and has an opening 38 aligned with the opening 22 of the bottle 12. The cap 16 may have internal threads 40 (FIG. 6) to engage with the external threads 28 of the top 20 of the bottle 12, or a groove (not shown) to engage with the external ridge of the top 20 of the bottle 12. It will be understood, however, that the cap 16 may be attached to the bottle 12 by configurations well known in the art. The cap 16 may create a seal with the top 20 of the bottle 12. The exterior surface 44 of the cap 16 may have ridges 46 and/or texture to aid a user in attaching and detaching the cap 16 to the bottle 12. The cap may have a spout portion 49, or the cap 16 may be substantially flat.

The tube 18 of the feeding bottle apparatus 10 has a first end 48 extending out of the bottle 12 and a second end 50 disposed within the bottle 12. The tube 18 runs through the opening 38 of the cap 16 and the opening 22 of the bottle 12. The first end 48 of the tube 18 has an opening 52 for discharging the flowable material 14. The first end 48 of the tube 18 may have a deflector member 54 disposed on at least one side 56 of the opening 52 such that the flowable material 14 is discharged at least partially to a side 58 of the first end 48. This allows the flowable material 14 to be more exactly directed within the mouth and throat of the user receiving the flowable material 14.

The second end 50 of the tube 18 may extend substantially the length of the bottle 12 such that the flowable material 14 may be reached, even to the bottom 24 of the bottle 12.

The tube 18 may be a single piece of tubing or may be comprised of multiple pieces of tubing, which may be connected together in conventional manners.

Referring now to FIGS. 2-8, in one embodiment a feeding bottle apparatus **10*a* is substantially similar to the feeding bottle apparatus 10 previously described, except as described herein below. The feeding bottle apparatus 10*a* comprises a bottle 12*a* for containing a flowable material 14, a cap 16*a*, and a tube 18*a*. The bottom 24*a* of the bottle 12*a* may have a convex center portion 70 and an outer portion 72 substantially surrounding the convex center portion 70 such that the flowable material 14 pools in the outer portion 72 of the bottom 24*a***.

In one embodiment, the bottle **12*a* curves along the length 26 between the top 20 and the bottom 24*a*. For example, the bottle 12*a* may curve approximately twenty degrees between the top 20 and the bottom 24*a*. However, any suitable angle or curve may be used to assist a user in gripping the bottle 12*a* and in discharging the flowable material 14 in a controlled and directed manner. In one embodiment, the angle may be such that the bottle 12*a* may remain substantially upright while in use so as to allow the flowable material 14 to be directed at an angle to the bottle 12*a* while maintaining a substantially vertical position of the bottle 12*a***.

The exterior surface 32 of the bottle **12*a* may have at least one textured area 34*a* to aid a user in maintaining contact with the bottle 12*a*. Additionally or alternatively, the exterior surface 32 may be ergonomically shaped to fit the user's hand. For example, the exterior surface 32 may have at least one ridged area 74 suitable for gripping the bottle 12*a***.

Figure 5:
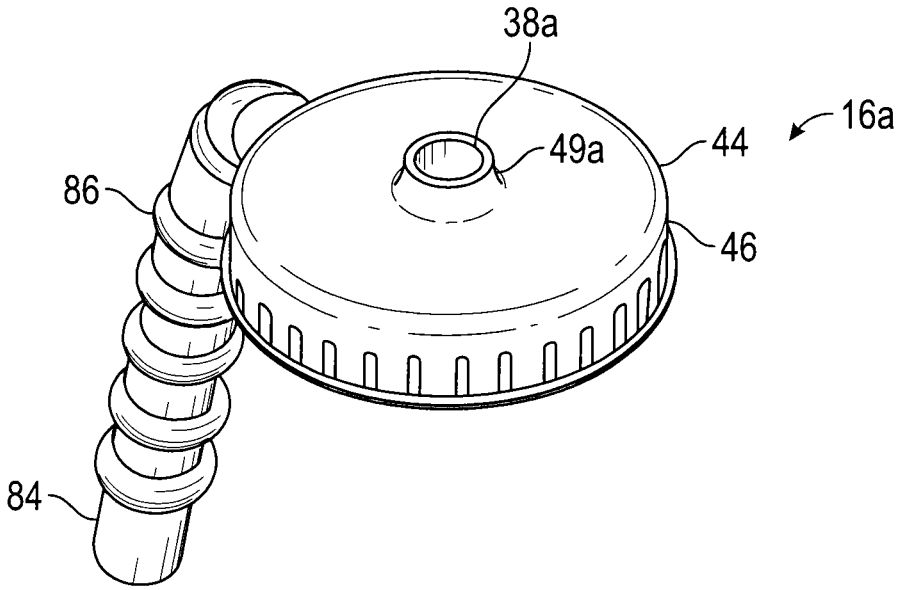
FIG. 5 is a perspective top plan view of the cap of the apparatus of FIG. 2.
Figure 6:
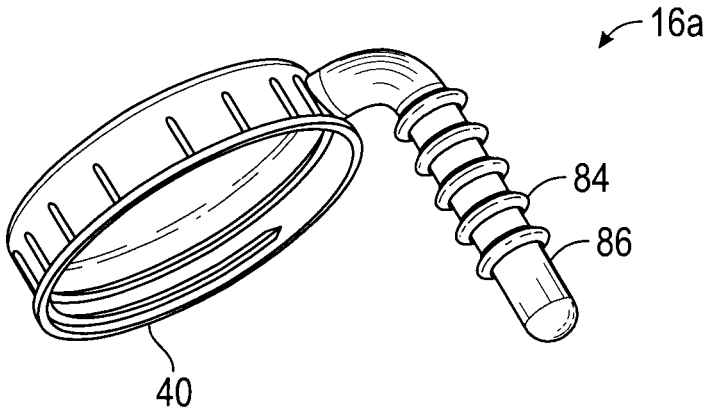
FIG. 6 is a perspective bottom plan view of the cap of the apparatus of FIG. 2.
Figure 7:
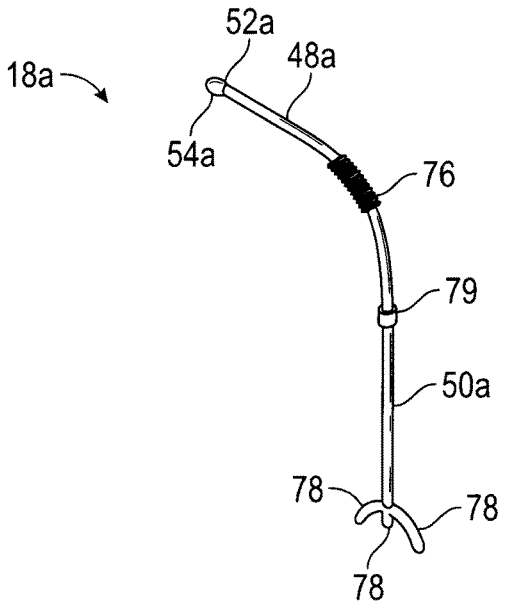
FIG. 7 is a side elevational perspective view of an exemplary tube of the feeding bottle apparatus constructed in accordance with the inventive concepts disclosed herein.
Figure 8:
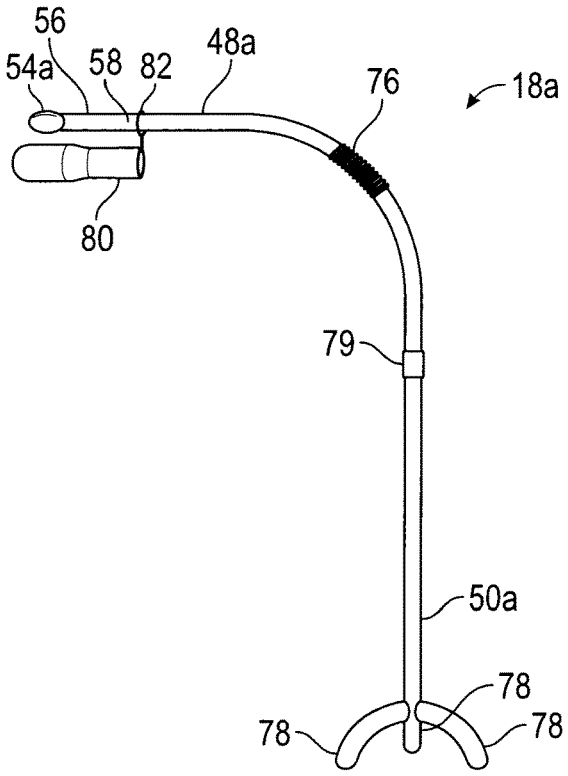
FIG. 8 is a side elevational view of the tube of FIG. 7.

Referring now to FIGS. 5 and 6, the cap **16*a* of the feeding bottle apparatus 10*a* is attachable to the top of the bottle 12*a* and has an opening 38*a* aligned with the opening of the bottle. In one embodiment, the cap 16*a* may have a spout portion 49*a*, or the cap 16*a*** may be substantially flat.

As shown in FIGS. 2 and 7-10, the tube **18*a* of the feeding bottle apparatus 10*a* has a first end 48*a* positionable out of the bottle 12*a* and a second end 50*a* positionable within the bottle 12*a*. The tube 18*a* is positionable to run through the opening 38 (and/or the spout portion 49*a*) of the cap 16*a* and the opening 22 of the bottle 12*a*. The first end 48*a* of the tube 18*a* has an opening 52*a* for discharging the flowable material 14. The first end 48*a* of the tube 18*a* may have a deflector member 54*a* disposed on at least one side 56 of the opening 52*a* such that the flowable material 14 is discharged at least partially to the side 58 of the first end 48*a*. The deflector member 54*a* may be flared to a width greater than the diameter of the first end 48*a* of the tube 18*a*. In one embodiment, the deflector member 54 is curved. In one embodiment, the deflector member 54 is spoon shaped. It will be understood that the deflector member 54*a* may be other suitable shapes that discharge the flowable material 14 at least partially to the side 58 of the first end 48*a* of the tube 18*a***.

In one embodiment, the deflector member **54*a* blocks the flowable material 14 from discharging straight out of the tube 18*a* and deflects the flowable material 14 entirely out of the side 58 of the tube 18*a***.

In one embodiment, the deflector member **54*a* is formed as a tubular member with a closed end and having a slot along the side 58 of the tube 18*a* such that the deflector member 54*a* blocks the flowable material 14 from discharging straight out of the tube 18*a* and deflects the flowable material 14 entirely out of the side 58 of the tube 18*a***.

Additionally or alternatively, the first end **48*a* of the tube 18*a* may have an articulating section 76 such that the first end 48*a* is selectively positionable to direct discharge of the flowable material 14. In one embodiment, the articulating section 76 of the tube 18***a* allows for expansion, contraction, and/or up to 360 degree rotation of the first end 48*a* of the tube 18*a*.

In one embodiment, the first end 48*a* of the tube 18*a* may be curved, so as to allow the flowable material 14 to be directed at an angle to the bottle 12*a* while maintaining a substantially vertical position of the bottle 12*a*.

In one embodiment, at least a portion of the tube 18*a* may be curved between the first end 48*a* and the second end 50*a* so as to substantially conform to the curved shape of the bottle 12*a*.

The second end 50*a* of the tube 18*a* may extend substantially the length of the bottle 12*a*. In one embodiment, the second end 50*a* of the tube 18*a* has at least one bottom member 78 positionable to reach the outer portion 72 of the bottom 24*a* of the bottle 12*a*, allowing the tube 18*a* to reach substantially all of the flowable material 14. The at least one bottom member 78 may be a part of the tube 18*a* or attachable to the second end 50*a* of the tube 18*a*. In one embodiment, the at least one bottom member 78 is three bottom members 78 positionable to reach the outer portion 72 of the bottom 24*a* of the bottle 12*a*. In one embodiment, the at least one bottom member 78 is four bottom members 78 positionable to reach the outer portion 72 of the bottom 24*a* of the bottle 12*a*. In one embodiment, at least one bottom member 78 is positionable to reach the convex center portion 70 of the bottom 24*a* of the bottle 12*a* and at least another bottom member 78 is positionable to reach the outer portion 72 of the bottom 24*a* of the bottle 12*a*.

In one embodiment, the tube 18*a* further comprises a check valve 79. The check valve 79 may be positioned between the first end 48*a* and the second end 50*a*. The check valve 79 may be positioned within the tube 18*a*. Alternatively, the tube 18*a* may be divided by the check valve 79. The check valve 79 may be positioned with the tube 18*a* such that the check valve 79 is positionable within the bottle 12*a* when in use.

The check valve 79 may be made in part or in its entirety of plastic. The check valve 79 may be classified as appropriate for use in medical devices and/or situations (i.e. medical grade). The check valve 79 may allow the flowable material 14 to flow up the tube 18*a* from the second end 50*a* to the first end 48*a* of the tube 18*a* only when a predetermined pressure is applied to the bottle 12*a*, such that the flowable material 14 does not continue to move through the tube 18*a* when the predetermined pressure is released from the bottle 12*a*.

In one embodiment, the feeding bottle apparatus 10, 10*a* further comprises a tube cap 80 positionable about the opening 52, 52*a* of the first end 48, 48*a* of the tube 18, 18*a* such that the flowable material 14 is not dischargeable when the tube cap 80 is in position on the tube 18, 18*a*. The tube cap 80 may be attachable to the feeding bottle apparatus 10, 10*a* by an attachment member 82 such that the tube cap 80 remains attached to the feeding bottle apparatus 10, 10*a* when the tube cap 80 is removed from the opening 52, 52*a* of the tube 18, 18*a*.

In one embodiment, the feeding bottle apparatus 10, 10*a* further comprises a handle 84. The handle 84 may extend from the cap 16, 16*a* or the bottle 12, 12*a*. The handle 84 may be hook shaped and/or may have ergonomic ridges 86 to facilitate the user gripping the handle 84.

Figure 9:
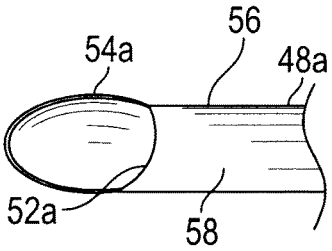
FIG. 9 is a partial side elevational view of the tube of FIG. 7.
Figure 10:
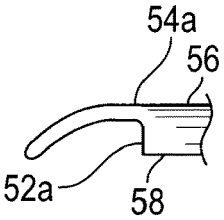
FIG. 10 is a partial top plan view of the tube of FIG. 7.
Figure 11:
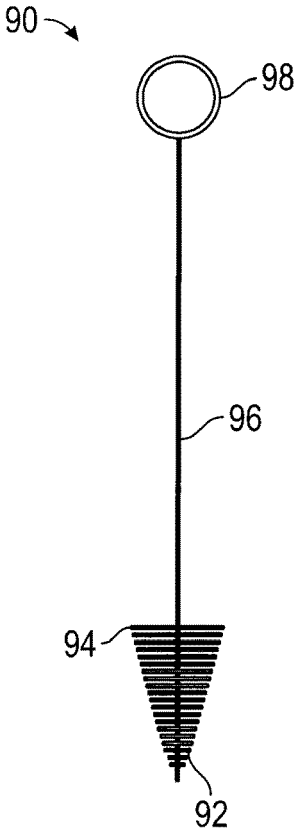
FIG. 11 is a side elevational view of a brush for use with the apparatuses of FIGS. 1 and 2.

In one embodiment, a feeding bottle kit 100 may comprise the feeding bottle apparatus 10, 10*a* and a brush 90, as shown in FIG. 9. The brush 90 has a cleaning member 92, such as bristles or sponge material, extending from a distal end of a shaft 96. The cleaning member 92 has an outer diameter 94 positionable in the interior of the tube 18, 18*a* to clean the tube 18, 18*a*. In one embodiment, the brush 90 has a length at least half the length of the tube 18, 18*a*. The brush 90 may have a handle 98.

In use, in one embodiment the bottle 12, 12*a* of the feeding bottle apparatus 10, 10*a* may be held substantially upright. Pressure applied to the bottle 12, 12*a* discharges the flowable material 14 through the tube 18, 18*a* into the recipient's mouth. The articulating section 76 of the tube 18*a* may be positioned to direct the flowable material 14, such as to the side of the throat of the recipient. Additionally, the tube 18, 18*a* may be rotated to position the opening 52, 52*a* of the first end 48, 48*a* of the tube 18, 18*a* and the deflector member 54, 54*a* to direct the flowable material 14 to the side of the recipient's throat, thus aiding swallowing and avoiding choking. In one embodiment, the articulating section 76 of the tube 18*a* allows for expansion, contraction, and 360 degree rotation of the first end 48*a* of the tube 18*a*.

The user may use the markings 36 on the exterior surface 32 of the bottle 12, 12*a* to determine the amount of flowable material 14 to be given and/or the amount discharged.

In one embodiment, the check valve 79 may prevent the flowable material 14 from being discharged once the pressure is removed from the bottle 12, 12*a*.

The user may position the tube cap 80 over the opening 52, 52*a* to further secure the flowable material 14 in the bottle 12, 12*a* and/or maintain cleanliness of the tube 18*a*.

The handle 84 may be used to assist in securely holding the feeding bottle apparatus 10, 10*a*. The handle 84 may be used as a hook to attach the feeding bottle apparatus 10, 10*a* to a bag or strap for ease of transport.

After use, the brush 90 may be used to clean the tube 18, 18*a* of the feeding bottle apparatus 10, 10*a*.

From the above description, it is clear that the inventive concepts disclosed herein are well adapted to carry out the objects and to attain the advantages mentioned herein as well as those inherent in the inventive concepts disclosed herein. While exemplary embodiments of the inventive concepts disclosed herein have been described for purposes of this disclosure, it will be understood that numerous changes may be made which will readily suggest themselves to those skilled in the art and which are accomplished within the scope of the inventive concepts disclosed and claimed herein.

What is claimed is:

1. An apparatus, comprising:

a cylindrical bottle for containing a flowable material, the bottle having a top with an opening, a bottom with a convex center portion and an outer portion substantially surrounding the convex center portion such that the flowable material pools in the outer portion of the bottom, and a length between the top and the bottom, at least a first portion of the bottle curving along the length between the top and the bottom, at least a second portion of the bottle comprising a transparent material such that the level of flowable material is visible, an exterior surface of the bottle having at least one textured area, at least one ridged area suitable for gripping the bottle, and markings indicative of an amount of flowable material in the bottle;

a cap attachable to the top of the bottle, the cap having an opening aligned with the opening of the bottle and a handle extending from the cap; and a tube extending through the opening of the cap and the opening of the bottle, the tube having a first end extending out of the bottle and a second end disposed within the bottle, the first end having an opening and a deflector member such that the flowable material is discharged at least partially to a side of the first end, the tube further having an articulating section such that the first end is selectively positionable to direct discharge of the flowable material, the second end extending substantially the length of the bottle and having at least one bottom member positionable to reach the outer portion of the bottom of the bottle;

wherein the bottle is formed of a flexible material such that pressure applied to the bottle discharges the flowable material through the tube.

2. The apparatus of claim 1, wherein the deflector member is spoon shaped.

3. The apparatus of claim 1, wherein the deflector member is shaped such that the flowable material is discharged entirely to the side of the first end of the tube.

4. The apparatus of claim 1, further comprising a tube cap positionable about the opening of the tube such that the flowable material is not dischargeable when the tube cap is in position on the tube.

5. The apparatus of claim 1, wherein the at least one bottom member of the tube is four bottom members.

6. The apparatus of claim 1, wherein the flexible material of the bottle is polyethylene.

7. The apparatus of claim 6, wherein the polyethylene is food grade polyethylene.

8. The apparatus of claim 1, wherein the flexible material of the bottle is food grade bioplastic.

9. The apparatus of claim 1, wherein the at least one bottom member of the tube is three bottom members.

10. The apparatus of claim 1, wherein the first end of the tube is separated from the second end of the tube by a check valve, such that flowable material is moveable from the second end of the tube through the check valve to the first end of the tube when a predetermined force is applied to the bottle.

11. A feeding bottle kit, comprising:

a feeding bottle apparatus, comprising:

a cylindrical bottle for containing a flowable material, the bottle having a top with an opening, having a bottom with a convex center portion and an outer portion substantially surrounding the convex center portion such that the flowable material pools in the outer portion of the bottom, and a length between the top and the bottom, at least a first portion of the bottle curving along the length between the top and the bottom, at least a second portion of the bottle comprising a transparent material such that the level of flowable material is visible, an exterior surface of the bottle having at least one textured area, at least one ridged area suitable for gripping the bottle, and markings indicative of an amount of flowable material in the bottle;

a cap attachable to the top of the bottle, the cap having an opening aligned with the opening of the bottle and a handle extending from the cap; and a tube extending through the opening of the cap and the opening of the bottle, the tube having a first end extending out of the bottle and a second end disposed within the bottle and a length, the first end having an opening and a deflector member such that the flowable material is discharged at least partially to a side of the first end, the tube further having an articulating section such that the first end is selectively positionable to direct discharge of the flowable material, the second end extending substantially the length of the bottle and having at least one bottom member positionable to reach the outer portion of the bottom of the bottle;

wherein the bottle is formed of a flexible material such that pressure applied to the bottle discharges the flowable material through the tube; and a brush having a length at least half the length of the tube and an outer diameter positionable in the interior of the tube.

12. The feeding bottle kit of claim 11, wherein the deflector member is spoon shaped.

13. The feeding bottle kit of claim 11, wherein the deflector member is shaped such that the flowable material is discharged entirely to the side of the first end of the tube.

14. The feeding bottle kit of claim 11, further comprising a tube cap positionable about the opening of the tube such that the flowable material is not dischargeable when the tube cap is in position on the tube.

15. The feeding bottle kit of claim 11, wherein the at least one bottom member of the tube is four bottom members.

16. The feeding bottle kit of claim 11, wherein the flexible material of the bottle is food grade polyethylene.

17. The feeding bottle kit of claim 11, wherein the flexible material of the bottle is food grade bioplastic.

18. The feeding bottle kit of claim 11, wherein the at least one bottom member of the tube is three bottom members.

19. The feeding bottle kit of claim 11, wherein the first end of the tube is separated from the second end of the tube by a check valve, such that flowable material is moveable from the second end of the tube through the check valve to the second end of the tube when a predetermined force is applied to the bottle.

20. A method of delivering ingestible flowable material to a patient orally, comprising:

obtaining a cylindrical bottle containing an ingestible flowable material, the bottle having a top with an opening, a bottom with a convex center portion and an outer portion substantially surrounding the convex center portion such that the flowable material pools in the outer portion of the bottom, and a length between the top and the bottom, at least a first portion of the bottle curving along the length between the top and the bottom, at least a second portion of the bottle comprising a transparent material such that the level of flowable material is visible, an exterior surface of the bottle having at least one textured area, at least one ridged area suitable for gripping the bottle, and markings indicative of an amount of flowable material in the bottle, the bottle having a cap with an opening;

positioning a tube extending through the opening of the cap and the opening of the bottle, the tube having a first end extending out of the bottle and a second end disposed within the bottle, the first end having an opening and a deflector member such that the flowable material is discharged at least partially to a side of the first end, the tube further having an articulating section such that the first end is selectively positionable to direct discharge of the flowable material, the second end extending substantially the length of the bottle and having at least one bottom member positionable to reach the outer portion of the bottom of the bottle;

positioning the deflector member of the tube in a patient's mouth;

applying pressure to the bottle to discharge the flowable material through the tube; and directing the flowable material through the mouth to the side of the back of the throat of a patient.

* * * * *